US012173497B2

(12) United States Patent
Beisl

(10) Patent No.: US 12,173,497 B2
(45) Date of Patent: Dec. 24, 2024

(54) ARRANGEMENT OF BUILDING UNITS

(71) Applicant: Engelbert Beisl, Wiesen (AT)

(72) Inventor: Engelbert Beisl, Wiesen (AT)

( * ) Notice: Subject to any disclaimer, the term of this patent is extended or adjusted under 35 U.S.C. 154(b) by 0 days.

(21) Appl. No.: 17/602,867

(22) PCT Filed: Apr. 10, 2020

(86) PCT No.: PCT/EP2020/060304

§ 371 (c)(1),
(2) Date: Oct. 11, 2021

(87) PCT Pub. No.: WO2020/208220

PCT Pub. Date: Oct. 15, 2020

(65) Prior Publication Data

US 2022/0178134 A1 Jun. 9, 2022

(30) Foreign Application Priority Data

Apr. 12, 2019 (AT) ..... A 50333/2019

(51) Int. Cl.

| | |
|---|---|
| ***E04B 1/348*** | (2006.01) |
| ***E04H 1/00*** | (2006.01) |
| ***E04H 1/04*** | (2006.01) |
| *E04B 1/00* | (2006.01) |

(52) U.S. Cl.

CPC ..... *E04B 1/348* (2013.01); *E04H 1/005* (2013.01); *E04H 1/04* (2013.01); *E04B 2001/0084* (2013.01)

(58) Field of Classification Search

None

See application file for complete search history.

(56) References Cited

U.S. PATENT DOCUMENTS

| | | | | |
|---|---|---|---|---|
| 5,199,231 | A * | 4/1993 | Dever | E04H 1/04 52/187 |
| 5,860,258 | A * | 1/1999 | Faith | E04H 1/02 52/236.2 |
| 2019/0141910 | A1* | 5/2019 | Marek | E04H 5/08 47/17 |

FOREIGN PATENT DOCUMENTS

| | | | |
|---|---|---|---|
| AT | 284402 | B | 9/1970 |
| DE | 1202468 | B | 10/1965 |
| EP | 0154100 | A1 | 9/1985 |
| FR | 2591644 | A1 * | 6/1987 |
| FR | 2948952 | A1 | 2/2011 |
| GB | 1059539 | A | 2/1967 |
| WO | 03106784 | A1 | 12/2003 |

OTHER PUBLICATIONS

PCT Search Report and Written Opinion dated Aug. 6, 2020 of International Application No. PCT/EP2020/060304.
EP Office Action dated Feb. 10, 2023 of Application No. 20 719.

* cited by examiner

*Primary Examiner* — Joshua K Ihezie
(74) *Attorney, Agent, or Firm* — Gordon & Jacobson, P.C.

(57) ABSTRACT

The invention relates to an arrangement of building units, comprising a plurality of housing units (1) constructed in a coupled design or a plurality of individual building units (1) accommodated in a multi-storey building, each building unit (1) having a pie-slice shaped floor plan with two side walls (2, 3) disposed at an angle (a) to one another, an inner terminating wall (4), and an outer terminating wall (5), the inner terminating walls (4) being disposed on the shady, north side, and the outer terminating walls (5) being arranged on the sunny, south side.

10 Claims, 7 Drawing Sheets

ARRANGEMENT OF BUILDING UNITS

CROSS-REFERENCE TO RELATED APPLICATIONS

This application is the National Stage of International Patent Application No. PCT/EP2020/060304 filed on Apr. 10, 2020, which claims priority from Austrian Patent Application No. A50333/2019 filed on Apr. 12, 2019, both of which are herein incorporated by reference herein in their entireties.

BACKGROUND

1. Field

The invention relates to an arrangement of building units, comprising a plurality of house units, which are built in coupled construction, or a plurality of single building units, which are located in a multi-story building.

2. State of the Art

Conventional building arrangements mainly comprise linearly arranged houses or building units, which are built in coupled construction along a street on adjacent plots of land, or building units in multi-story buildings, which are also built-in rows or in a rectangle. In such conventional, i.e. linear, arrangements, (in the case of house complexes) the associated plots usually have the same width as the houses and are accordingly extraordinarily narrow. In any case, they are usually rectangular. The same applies to the premises. They also have the actual width, which is not perceived as wider or larger.

One of the disadvantages of such linear arrangements is also that the respective neighbors have an unobstructed view of the respective neighboring plot and also do not enjoy sufficient privacy in terms of acoustics. Moreover, such rows of houses often create a monotonous dreary look. The narrowness of the plots is also disadvantageous when planting the garden and the perceived size of the plot corresponds to the actual size, which is naturally very small in such complexes.

The picture is the same for the upper floors—if any outdoor space is created, it is linear balconies that are narrow and do not provide sufficient privacy, both visually and acoustically.

A further disadvantage lies in the utility development of rows of townhouses or linearly arranged building units, since relatively long supply lines and drainage lines have to be laid to each individual house/building unit.

It has already been proposed not to arrange houses and building units next to each other in a linear form, but to give the houses a pie-piece-like ground plan and to arrange such house units in a circular form or in large circles. An example of this is WO 03/106784 A1.

The disadvantage of all these arrangements is that a courtyard is arranged inside the house arrangement, to which the associated inner end walls open, whereby the main orientation of living and use is directed to this shady, reduced side and the privacy is therefore disturbed, and that the access area, entrance area, anteroom and utility area of the houses are arranged on the large-area outer end walls, to which the sun and light as well as the main orientation of living or use should be directed. In a disadvantageous way, this also leads to mutual disturbance of the residents given that the view of the respective neighboring plot is visually accessible, and furthermore, several of the residential units are located in the northern area, so that the orientation of these house units is unfavorable. Considered in detail, it must be stated that all these complexes are disadvantageous from both a visual and functional point of view.

In multi-story house arrangements, similar problems arise due to mutual disturbance and unfavorable orientation of house units to the north.

SUMMARY

The present invention sets itself the task of avoiding the aforementioned disadvantages and creating an arrangement of building units which is optimized in terms of sun orientation or orientation to the light and which allows users to live and work or otherwise use the building unhindered by neighbors. The visual design should thus be softened and appealing. The use of the garden areas or loggias should offer better possibilities for design and use and, above all, due to the rotation and indentation, more privacy both visually and acoustically.

The invention solves the set tasks by the features of the claims.

The invention relates to an arrangement of building units, comprising a plurality of house units, which are built in coupled construction, and/or a plurality of single building units, which are located in a multi-story building. Optionally, each building unit may have a pie-piece-like ground plan with two side walls lying at an angle $\alpha$ to each other, an inner end wall and an outer end wall. Optionally, it is provided that the inner end walls are arranged on the north side on the shadow side and the outer end walls are arranged on the south side on the sun side.

Optionally, it is provided that the two outer side walls of the arrangement of building units lie at an angle $\beta$ as a multiple of the angle $\alpha$ to each other, where $\beta$ is between 45° and 270°.

Optionally, it is provided that the inner end walls have the house entrance doors with access to a house entrance area with a staircase and/or that in particular in the case of a multi-story arrangement of the building units, in an upper story, access is provided from the staircase to a wet and sanitary area and to a room.

Optionally, it is provided that the outer end walls facing south and/or facing the sun are provided with at least one terrace door and/or one loggia door each.

Optionally, it is provided that the side wall adjacent to the terrace door and/or the loggia door has a wall extension as a view protection and/or windbreak.

Optionally, it is provided that the end wall has a setoff towards the terrace door and/or the loggia door and that a terrace or balcony/loggia is arranged between the setoff and the sidewall.

Optionally, it is provided that a central access area is formed by lining up the inner end walls.

Optionally, it is provided that the arrangement of building units is arranged on a plot of land, which, in extension of the side walls, may optionally be subdivided or parceled out into plots, as required, which are associated with the individual house units.

Optionally, it is provided that, in the case of a multi-story arrangement of the building units, an elevator shaft is provided for the installation of an elevator.

Optionally, it is provided that, in particular in the case of a multi-story arrangement of the building units, a staircase extending to all stories and an elevator shaft are provided in the access area.

Further, it may be provided that the entire building complex has an exterior angle of at least 90° and at most 270° and that the complex is mainly oriented to the east-south-west, and, in the case of an angle of more than 180°, the building units oriented to the north are used as side rooms or working areas (office, doctor's office, etc.). Each building unit consists of a pie-piece-like ground plan with two side walls, which lie at a right angle or an acute angle to each other, an inner end wall and an outer end wall.

Another significant advantage of the invention is the perceived room size both inside and outside of the building. Just like the gardens, the rooms appear much larger than they actually are. This is achieved in particular by the fact that the rooms always widen towards the sun or light due to the acute angles of the building units. This also applies to the gardens (in the case of house complexes with gardens). The perceived room size thus exceeds the actual room size by far.

Another advantage is that the supply sections of the house units arranged next to each other and possibly one above the other require short distances, so that the necessary investments are smaller.

The orientation of the large glass surfaces to the sun or light and the arrangement of the utility rooms such as bathrooms, anterooms, storerooms, etc. on the north side also result in significant advantages in terms of energy. The north side is designed without significant glass elements and thermally very well insulated, so that the energy loss on the north side is minimized; the glass fronts aligned with the course of the sun supply the house not only with light but also with energy.

In the following, the invention is explained in more detail by means of the figures. All figures are only exemplary and do not limit the invention. FIGS. 1 to 7 show an exemplary two-story townhouse complex. FIGS. 8 to 10 show an exemplary eight-story high-rise.

BRIEF DESCRIPTION OF THE DRAWINGS

FIG. 1 shows a complex of eight building blocks 16, each with four building units 1. Each block is arranged along an access road 17. Each building block 16 is located on a contiguous plot of land 18 with the fan-shaped division into the individual plots 19 for the individual house units 1. Each building block 16 comprises four house units 1 with associated plot 19. For explanatory purposes only, two double garages 20 each are shown in FIG. 1, although there may also be space for the driveway, parking area and waste containers in the forecourt 21.

DETAILED DESCRIPTION

Between the plots of land 18, narrower access paths are provided, allowing access to the plots of land 18 from other sides.

In the center or, depending on the nature of the plot, in another central location, general communication and general facilities 29 will be created. In the case of housing complexes, they may include a children's playground, a barbecue area, a sauna hut, a swimming pool, a swimming pond, and the like. In the case of office complexes or commercial facilities, they may be a general debriefing center, a technical center, and the like. In the case of retirement homes, they may be a doctor's office, a house pharmacy, rooms for care staff, a coffee shop, and the like. In the case of tourist complexes, they may be swimming pools and wellness facilities, etc.

Figure 1:
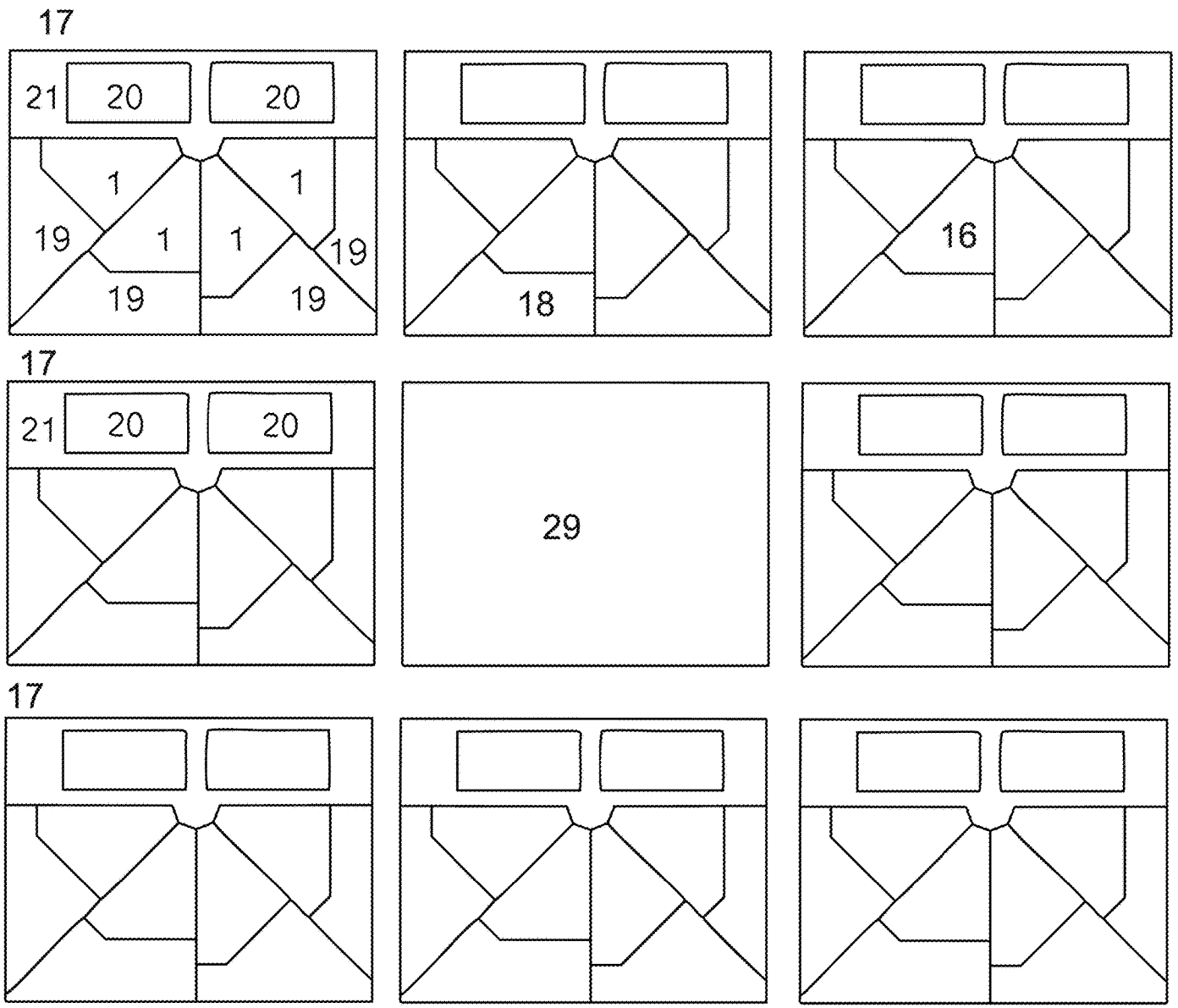
FIG. 1 shows a complex of eight building blocks 16, each with 4 building units 1 arranged according to the invention, as seen from above in schematic view.
Figure 2:
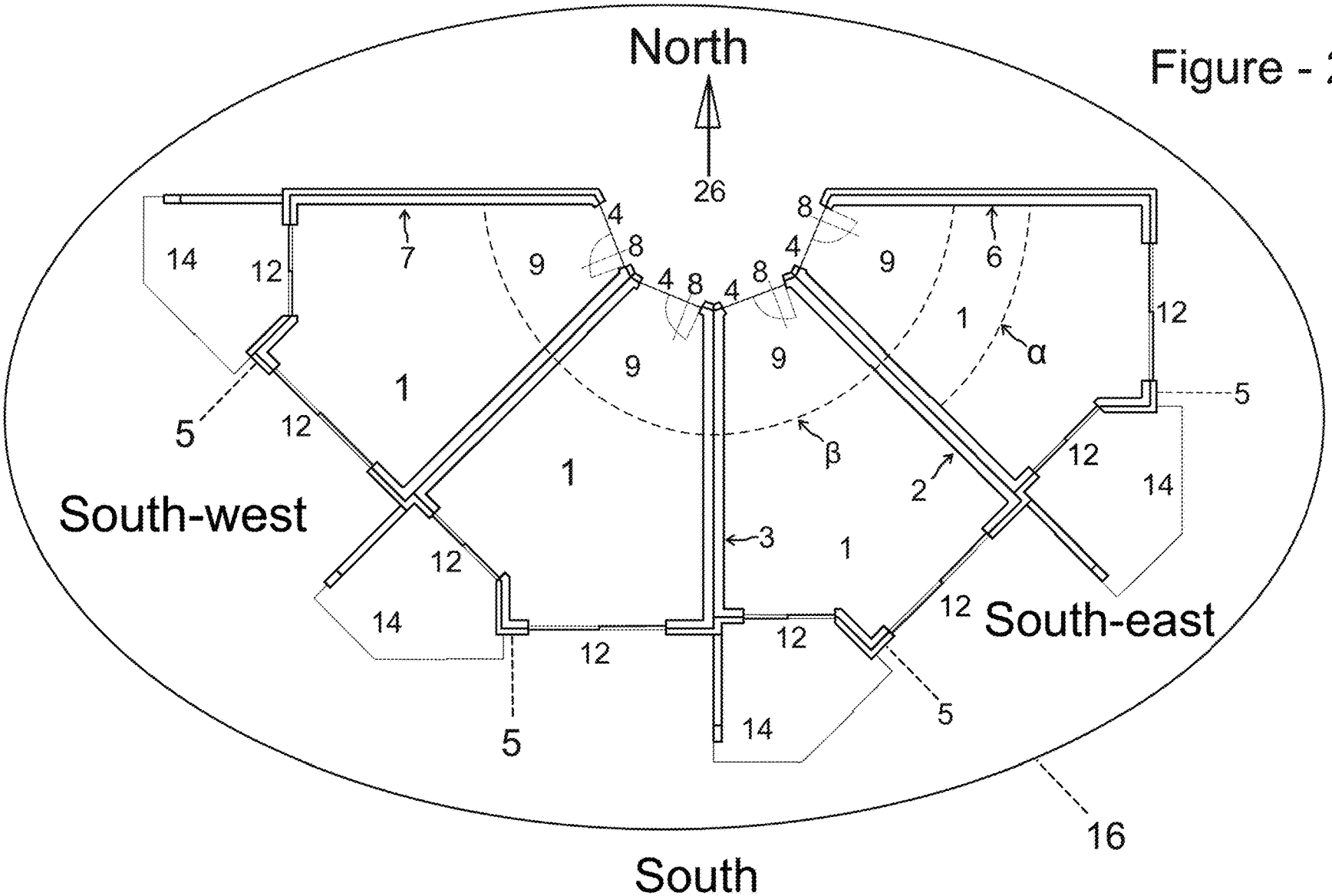
FIG. 2 shows an example of the ground plan of an inventive arrangement of four building units.

FIG. 2 shows an exemplary embodiment of a building block 16 of the arrangement of building units, consisting of four individual house units 1. Each house unit 1 comprises side walls 2, 3 arranged at an angle to each other, which in the present case each enclose an interior angle $\alpha$ of 45°. For the four house units 1 shown, this results in a building angle $\beta$ of 180°, measured from the outer side wall 6 to the outer side wall 7.

As can be seen in the drawing, each house unit 1 is pie-piece-shaped. The side walls 2, 3 are connected at their two ends by a narrow inner end wall 4 and an outer end wall 5, which is several times wider, which form the building envelope. The inner narrow and largely north-facing end wall 4 includes the house entrance door 8, which opens into the house entrance area 9.

The outer end wall 5, which is several times wider, extends to the respective plot 19 and opens to the terrace 14 via one or more terrace doors 12 and is largely oriented to the east-south-west, i.e. to the sun or light side. The terraces 14 are separated from each other due to the rotation, which is further pronounced by the setoff and a partition wall.

The house block 16 is preferably oriented in such a way that the outer end walls 5 are facing the sun side, i.e. to the east, south and west on the northern hemisphere. The preferred north-south direction is indicated. A key feature is that no house unit 1 is arranged to the north to avoid the disadvantages associated with the north orientation. Exceptions may be made in case of working areas such as offices, doctor's offices, common rooms, etc.

Between the narrow inner end walls 4, a common access area 26 to the individual house units 1 is created, where shared facilities may be provided. The respective outer units may also be accessed via the north-facing side walls.

The improved access for the entire house block 16 can be star-shaped centrally from this area, which brings great advantages.

The invention is not restricted to the arrangement of four building units 1 shown in FIG. 2. The minimum size of an arrangement of building units is two house units 1. However, more than four house units 1 may be provided, and the building angle $\beta$ may be greater or less than 180°. Also in the case of such a bigger/smaller arrangement, the individual house units 1 are still facing the sun side and the outer side walls 6 and 7 are oriented to the north. Building units containing side rooms or working areas may also be oriented to the north.

Figure 3:
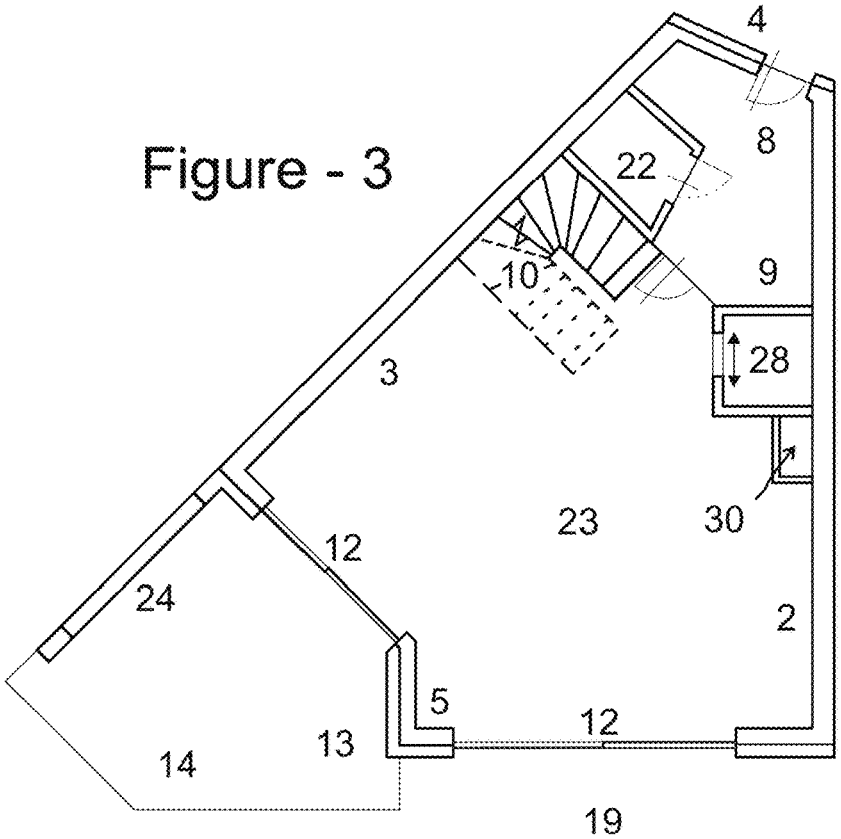
FIG. 3 shows the ground plan of the ground floor of a house unit.
Figure 4:
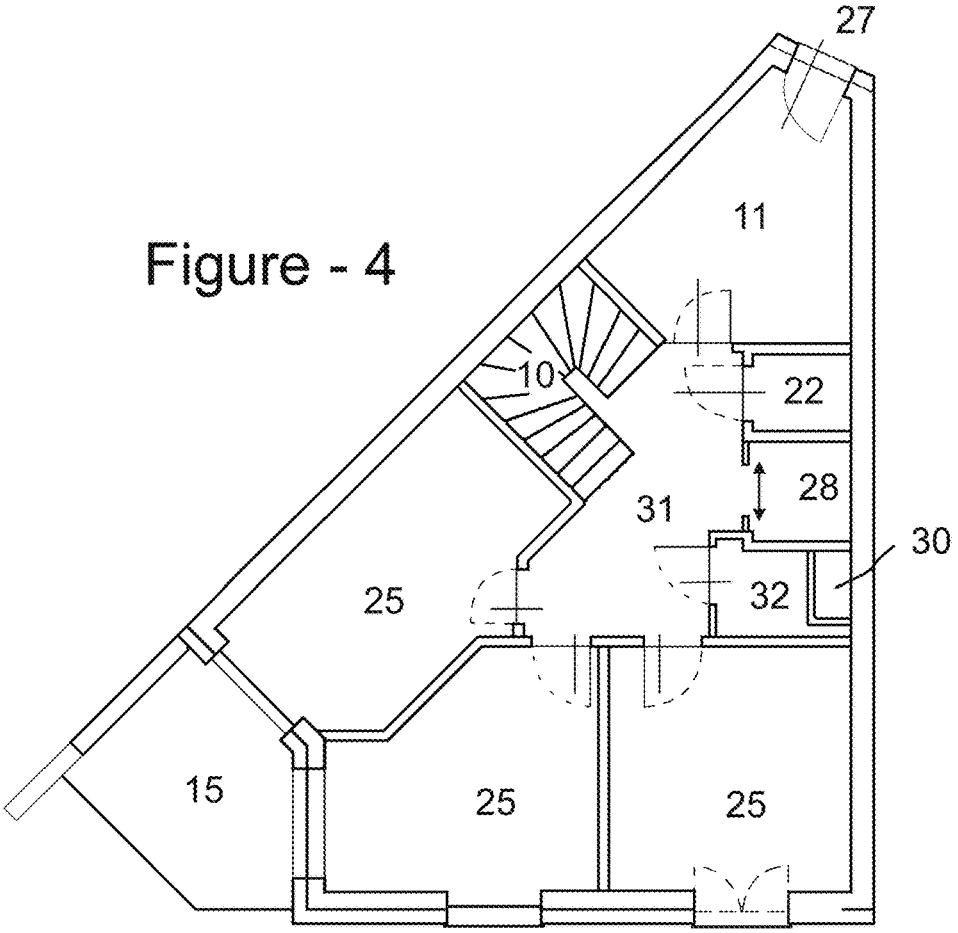
FIG. 4 shows the ground plan of the upper floor of this house unit.

FIGS. 3 and 4 show examples of interior spatial arrangements for the ground floor (FIG. 3) and the upper floor (FIG. 4).

The house entrance door 8 leads to the house entrance area 9 with an open staircase arrangement 10, which leads to the upper floor. From the house entrance area 9, one reaches the toilet 22 and the spacious living area 23 with integrated kitchen. The pieces of furniture are not shown.

From the living area 23, a terrace door 12 leads to the terrace 14 and from there further to the garden area of the plot 19.

The terrace 14 is protected from the neighboring plot or the neighboring terrace due to the rotation and a setoff 13. An oblique upward wall extension 24 of the side wall 3 further enhances this protection.

Again, it should be noted that the described use serves as an example and the buildings according to the invention are by no means limited to residential purposes. Offices, working areas, accommodation premises, doctor's offices, commercial premises and much more are conceivable. The use itself is not the object of the invention, but rather the building formation and the benefits thereby created for the versatile uses.

As can already be seen from this ground plan, this and each house unit 1 is open to the sun side and the associated garden and oriented towards the light. In contrast, the usually cold north side of house unit 1 is oriented only towards the inner end wall 4, which is also advantageous in terms of energy.

On the upper floor according to FIG. 4, the staircase 10 leads to the anteroom 31. From this anteroom, in addition to the wet and sanitary area 11, the toilet 22, the elevator shaft 28 and the storage room 32, one reaches a number of rooms 25, with two rooms 25 leading to a balcony 15, which is located above the terrace 14 below. The balcony 15 is also protected by the wall extension 24 and the setoff 13.

Behind the storage room 32, the utility shaft 30 is located. As long as no elevator is installed, the entire room 28 (elevator) and 32 (storage room) can be used as a closet space. In this case, a door may directly lead from the bedroom 25 to the closet space.

Figure 5:
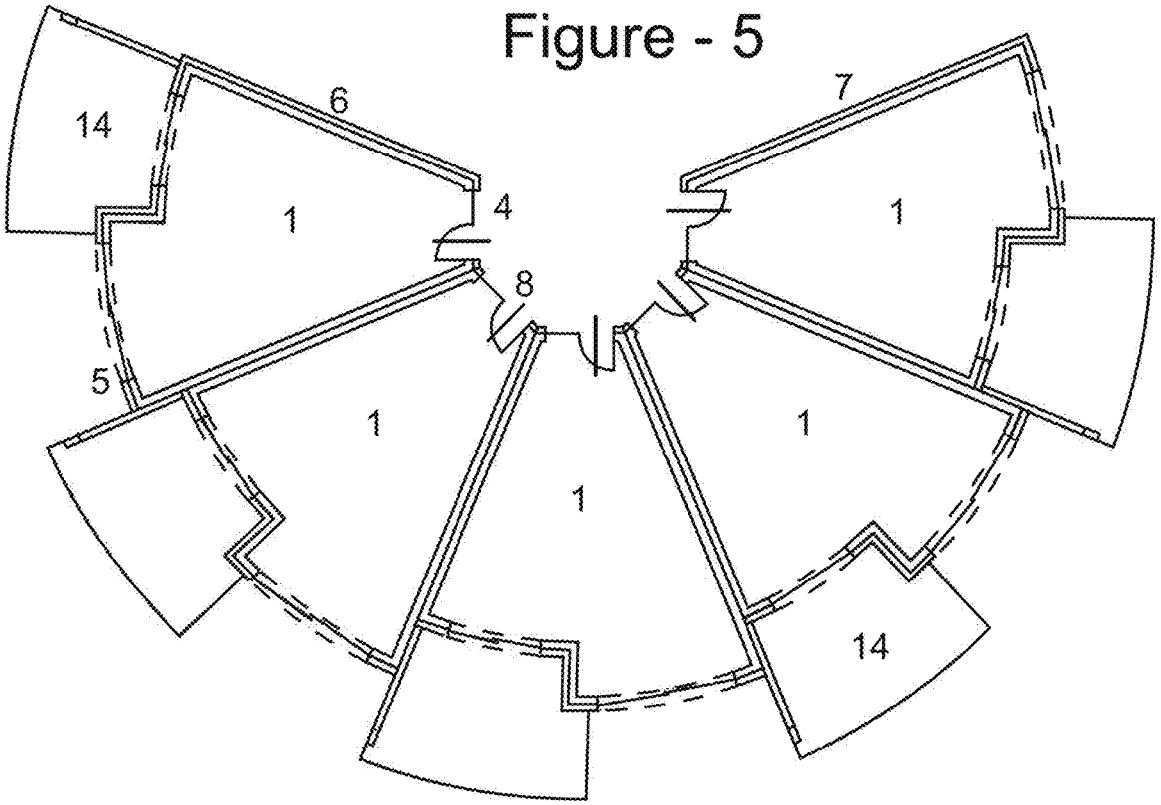
FIG. 5 schematically shows the ground plan of another embodiment of the townhouse arrangement.

FIG. 5 shows a building block 16 with five house units, with the building angle being greater than 180°. In this example, the outer end wall 5 is round and shows that the design of the house units 1 may vary. The interior design may be designed freely.

Figure 6:
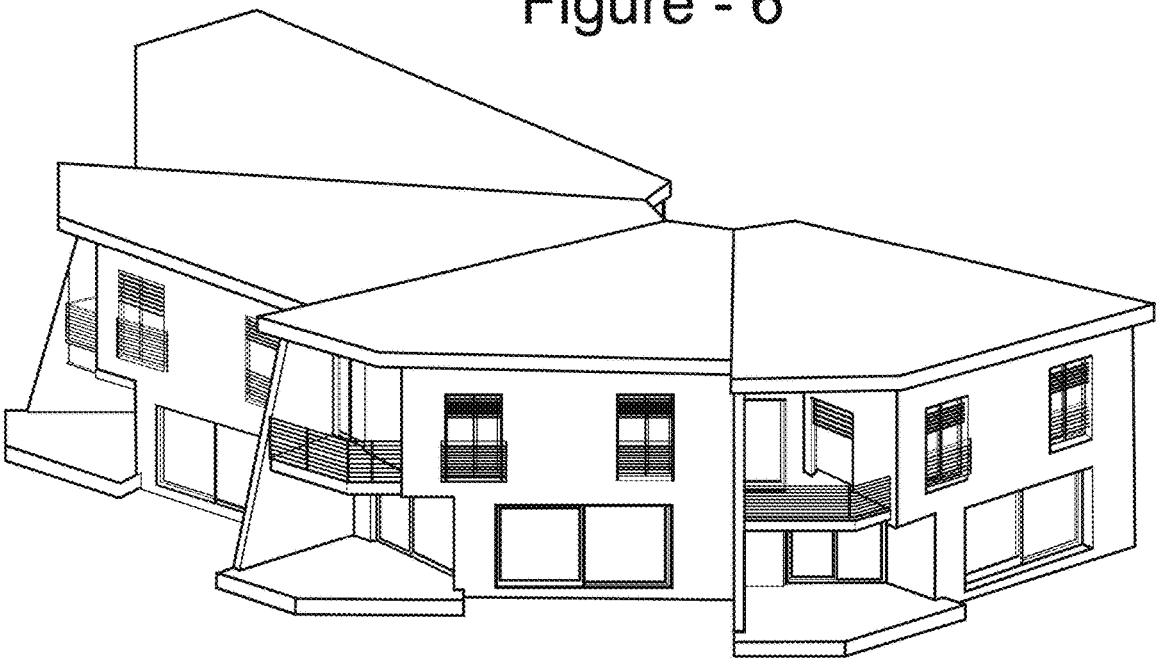
FIG. 6 shows an oblique view of a townhouse arrangement having four house units in the finished state.

FIG. 6 serves to provide an illustrative overview of an inventive arrangement of building units, in this case townhouses, each with an upper floor and a roof; this figure speaks for itself.

Figure 7:
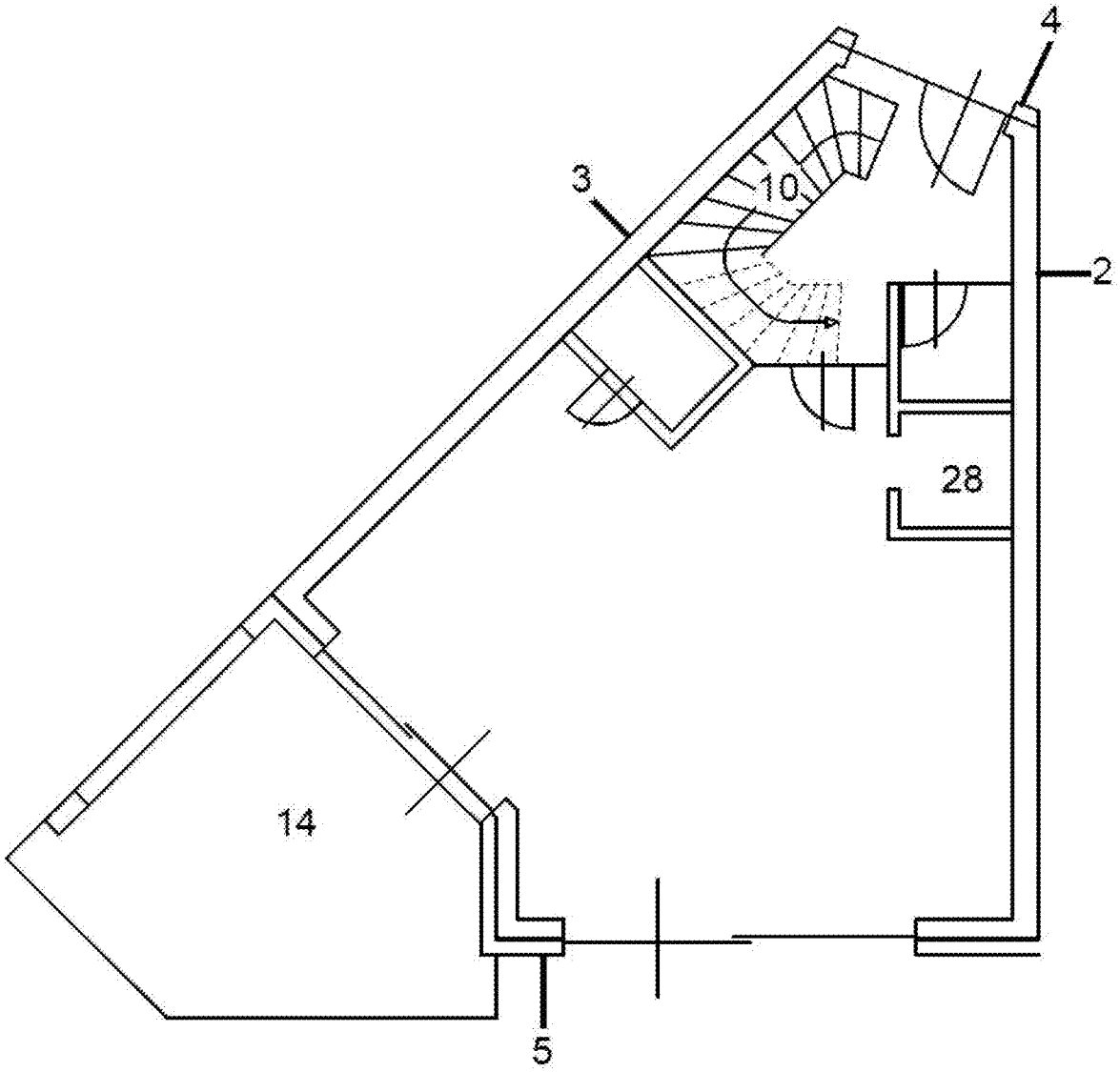
FIG. 7 shows an alternative ground plan of an arrangement of building units, having a staircase outside the living area.

FIG. 7 shows an example of an alternative room layout for the ground floor, wherein an elevator shaft 28 and a staircase 10 lead to an upper floor, which is not shown here.

Figure 8:
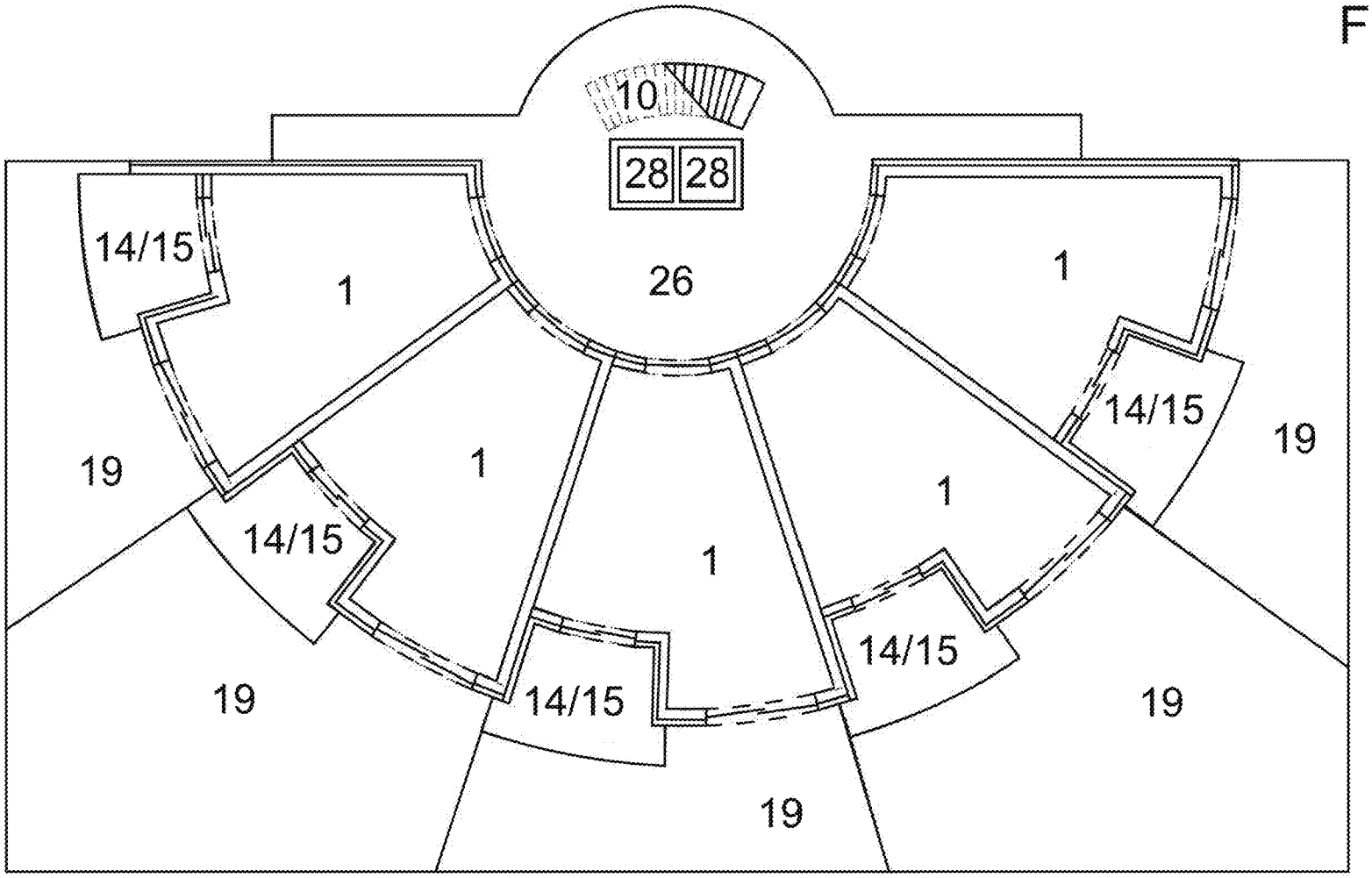
FIG. 8 shows an example of the ground plan of an eight-story high-rise.

FIG. 8 shows an example of the ground plan of an eight-story high-rise. The inventive arrangement of building units may also be multi-story, wherein multiple building units 1 may be arranged next to each other or on top of each other. In the case of multi-story arrangements, an elevator shaft 28 or multiple elevator shafts 28 as well as a staircase construction 10 or multiple staircase constructions 10 may be provided in the access area 26 to provide central access to all floors. Analogous to the other exemplary embodiments, there may be gardens 19 or terraces 14 on the ground floor, and loggias 15 on the upper floors.

Figure 9:
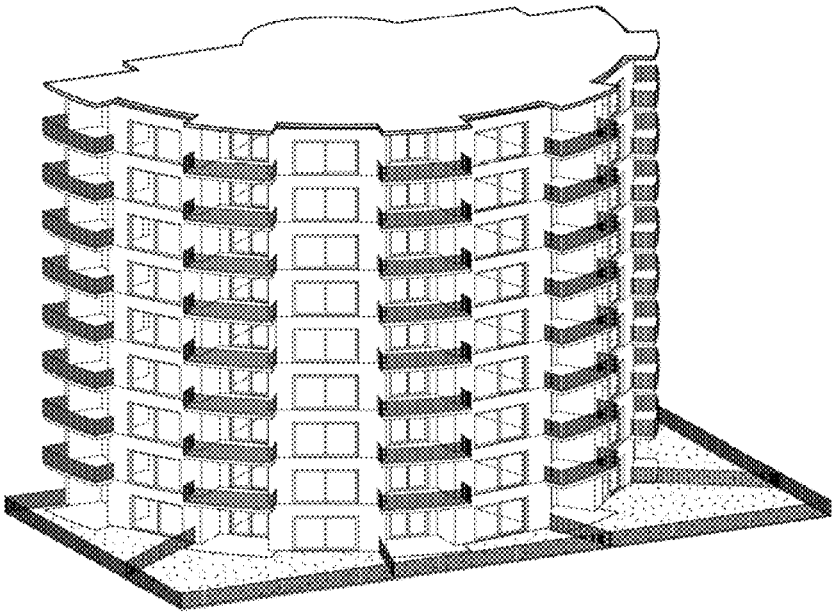
FIG. 9 shows an exemplary front view of the same eight-story high-rise.

FIG. 9 shows an exemplary front view of the same eight-story high-rise in 3D.

Figure 10:
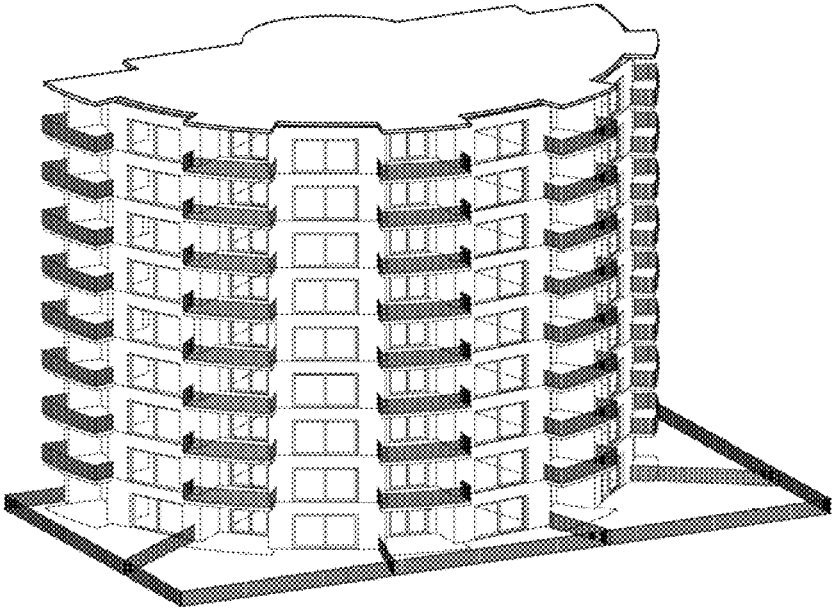
FIG. 10 shows an exemplary rear view of the same eight-story high-rise.

FIG. 10 shows an exemplary rear view of the same eight-story high-rise in 3D.

As already mentioned above, the illustrated arrangements of building units 1 to each other as well as the room layouts in the building units 1 are only exemplary. Of course, the interior design must meet the architectural requirements.

In any case, it is advantageous that the circular or stepped arrangements lead to the outer end wall 5 having the greatest width as the light side, so that the habitable rooms have the greatest incidence of light. For example, in a two-story residential building with a living area of only 125 $m^2$, a width of 9.2 m can be achieved on the outer end wall 5 in the area facing the sun or light.

In the arrangement as townhouse complex, the gardens 18 become wider and seem larger than with a rectangular arrangement. The terraces 14 and balconies 15 are angled away from each other and indented into the building, so they are more sheltered and offer more privacy from the neighbor. The large glass surfaces towards the light side and the termination to the north side result in advantages in terms of energy.

LIST OF REFERENCE SIGNS

1 House unit
2 Side wall
3 Side wall
4 Inner end wall
5 Outer end wall
6 Outer side wall
7 Outer side wall
8 House entrance door
9 House entrance area
10 Staircase
11 Wet and sanitary area
12 Terrace door
13 Setoff
14 Terrace
15 Balcony
16 Building block
17 Access road
18 Plot of land
19 Plot
20 Double garage
21 Forecourt
22 Toilet
23 Living area
24 Wall extension
25 Bedroom
26 Access area
27 Oriel
28 Elevator shaft
29 General area in the outdoor area
30 Supply channel
31 Anteroom
32 Closet space/storage room
α Internal angle
β Building angle

The invention claimed is:

1. An arrangement of building units, comprising:

a plurality of building units, which are built in coupled construction, wherein each building unit has a pie-piece-like ground plan with two side walls lying at an angle (α) relative to each other, a narrower inner end wall having an entrance door, and a wider outer end wall having at least one terrace door, wherein the narrower inner end walls and the entrance doors of the plurality of building units face north with the entrance doors of the plurality of building units opening to a common entrance area on a north side, wherein the wider outer end walls and the terrace doors of the plurality of building units face south with the terrace doors of the plurality of building units opening to separate terraces on a south side, and wherein the wider outer end wall of each building unit has a setoff with the terrace arranged between the setoff and a corresponding sidewall.

2. The arrangement of building units according to claim 1, wherein two outer end walls of the arrangement of building units lie at an angle β relative to each other, where the angle (β) is as a multiple of the angle (α) between 45° and 270°.

3. The arrangement of building units according to claim 1, wherein the entrance doors of the plurality of building units each provide access to a house entrance area with a staircase.

4. The arrangement of building units according to claim 1, wherein the plurality of building units is located in a multi-story building.

5. The arrangement of building units according to claim 1, wherein the side wall adjacent to the terrace door has a wall extension as a view protection and/or windbreak.

6. The arrangement of building units according to claim 1, wherein the common entrance area is formed by lining up the inner end walls.

7. The arrangement of building units according to claim 1, wherein the arrangement of building units is arranged on a plot of land, which, in extension of the side walls, may optionally be subdivided or parcelled out into plots, as required, associated with individual house units.

8. The arrangement of building units according to claim 4, further comprising an elevator shaft configured for installation of an elevator.

9. The arrangement of building units according to claim 4, further comprising a staircase extending to all stories and an elevator shaft in the common entrance area.

10. The arrangement of building units according to claim 4, wherein access is provided in an upper storey by a staircase to a wet and sanitary area and to a room.

* * * * *